United States Patent [19]

Campbell

[11] 4,061,202

[45] Dec. 6, 1977

[54] HUNTING STAND

[76] Inventor: Donald E. Campbell, 9575 Gorman Road, Laurel, Md. 20810

[21] Appl. No.: 672,735

[22] Filed: Apr. 1, 1976

[51] Int. Cl.[2] ..... E06C 1/10; E06C 1/36; E06C 7/48

[52] U.S. Cl. ..... 182/20; 182/100; 182/116; 182/187; 182/214

[58] Field of Search ..... 182/116, 214, 187, 20, 182/21, 206, 93, 189, 100; 403/353

[56] References Cited

U.S. PATENT DOCUMENTS

| | | | |
|---|---|---|---|
| 1,804,420 | 5/1931 | Kelley | 403/353 |
| 2,833,333 | 5/1958 | Babineau | 182/187 |
| 3,028,929 | 4/1962 | Chubbs | 182/214 |
| 3,336,999 | 8/1967 | McSwain | 182/116 |
| 3,368,725 | 2/1968 | Martin | 182/187 |

FOREIGN PATENT DOCUMENTS

| | | | |
|---|---|---|---|
| 1,313,696 | 11/1962 | France | 182/93 |
| 903,147 | 2/1954 | Germany | 182/93 |
| 484,929 | 9/1953 | Italy | 182/189 |

*Primary Examiner*—Reinaldo P. Machado

*Attorney, Agent, or Firm*—Morton J. Rosenberg

[57] ABSTRACT

An improved hunting stand which is vertically displaceable from a ground surface and is adapted to be mounted to a supporting element such as a tree. The improved hunting stand includes a platform area where the user may position himself for extended periods of time. Additionally, a sectional ladder is provided which is inserted into the ground and the platform on opposing ends thereof. A stand securing device is mounted to the platform and lockingly engages the supporting element in discrete segmental areas. The stand securing mechanism is adapted to grip the supporting member in a load bearing and frictional interface and not impale the surface of the support element. Additionally, the stand securing mechanism can be attached above or below impeding tree limbs without having to remove the limbs. In this manner, the stand securing device provides for advantageous ecological consequences wherein the external environment is not harmed by the user. The various elements of the improved hunting stand are modular in nature and can be compacted into a package which allows portability.

2 Claims, 5 Drawing Figures

HUNTING STAND

BACKGROUND OF THE INVENTION

1. Field of the Invention

This invention pertains to apparatus which are used by hunters. In particular this invention relates to improved hunting stands which may be mounted against a supporting element such as a tree. Still further, this invention pertains to improved hunting stands which grip the supporting element while causing no damage to the element. Still further, this invention relates to a portable improved hunting stand which is modular in construction and can be packaged to be carried on the back of a user to an appropriate spot. More in particular, this invention pertains to an improved hunting stand which is relatively simple to assemble and maintain in a proper supported position.

2. Prior Art

Hunting stands to position hunters in a particular location are known in the art. However, in some prior hunting stands, the user was forced to build a vertically displaced platform which generally resulted in extensive use of time and possible ecological damage due to the fact that some of such prior platforms were nailed to the supporting tree elements.

In some prior cases, hunting stands provided gripping surfaces which impaled the supporting element or even required the removal of obstructing tree limbs. Thus, the surface of the supporting element or tree was broken and ecological damage may have resulted from use of such hunting stands.

Some other prior hunting stands were not modularly constructed resulting in transportation of bulky and large portions of the hunting stand. This prior type of stand device limited the range of the hunter since in many instances such prior hunting stands had to be transported by vehicle.

SUMMARY

A hunting stand vertically displaced from a ground surface and adapted to be mounted to a tree. The hunting stand includes a platform mechanism having an extended planar surface. Additionally, a sectional ladder mechanism is removeably constrained to the ground surface and the platform mechanism on opposing ends thereof. The hunting stand includes a stand securing device which is movably mounted to the platform mechanism for frictionally gripping the tree in segmental portions around a peripheral boundary.

DESCRIPTION OF THE PREFERRED EMBODIMENTS

Figure 1:
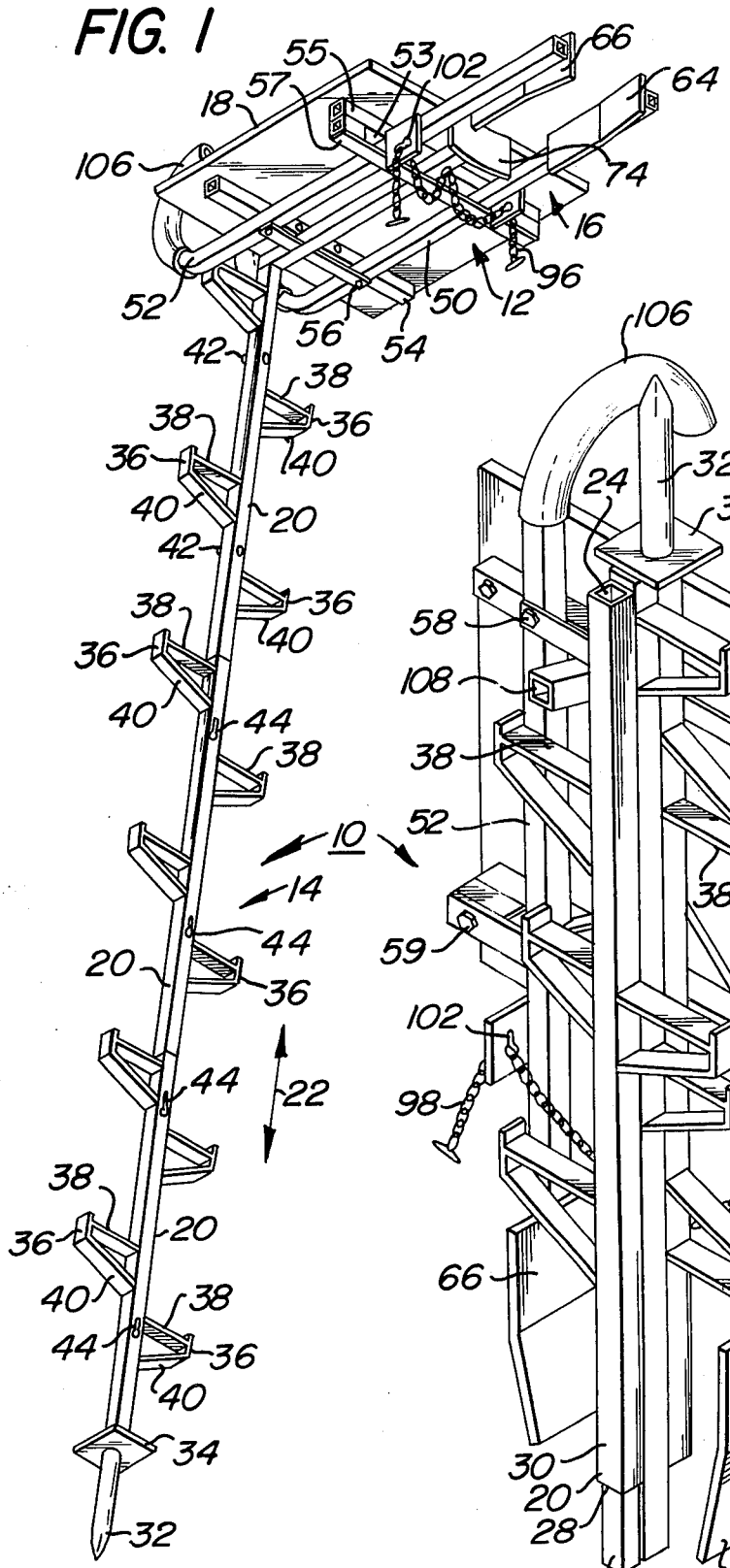
FIG. 1 is a perspective view of the improved hunting stand.

Referring now to FIGS. 1-5 there is shown improved hunting stand 10 which in its operable position is vertically displaced from the ground and adapted to be mounted to a tree or other like supporting element. As will hereinafter be described, and as is clearly seen in FIG. 2, improved hunting stand 10 is composed of a multiplicity of elements which permit portability and allows the user to manually transport stand 10 in a compact manner until a specific hunting spot is chosen by the user.

Additionally, hunting stand 10, being supported between the ground and a vertically extending member such as a tree or other support strcuture is specifically adapted in its mechanical actuating elements to provide a minimal amount perturbance to the enviornment and no damage to the supporting tree structure. Improved hunting stand 10 is specifically constructed such that it may be supported by a tree in a manner such that the tree is grasped in frictional engagement without the bark or external boundary wall of the tree being cuttingly engaged. Thus, in an ecological sense, improved hunting stand 10 maintains the external enviornment in an undamaged condition while providing support for the user when he is hunting. In use, improved hunting stand 10 may be used as an observation post, by gun hunters, and in particular by bow hunters. Stand 10, allows for a safe shooting area due to the fact that the hunter is vertically displaced from the ground and permits the hunter to shoot downward without fear of causing injury to other hunters or of being attacked by the animal.

In overall concept, improved hunting stand 10 includes platform mechanism 12 upon which the hunter or user may sit or stand in a relatively stabilized manner. Additionally, improved hunting stand 10 provides for sectional ladder 14 which is insertable within the ground and removably constrained thereto to provide the vertical extension of stand 10 above the ground surface. Stand securing device 16 is movably mounted to platform 12 and is adapted to frictionally grip the tree in segmental areas as will hereinafter be described, around a peripheral boundary surface or wall of the tree.

Figure 3:
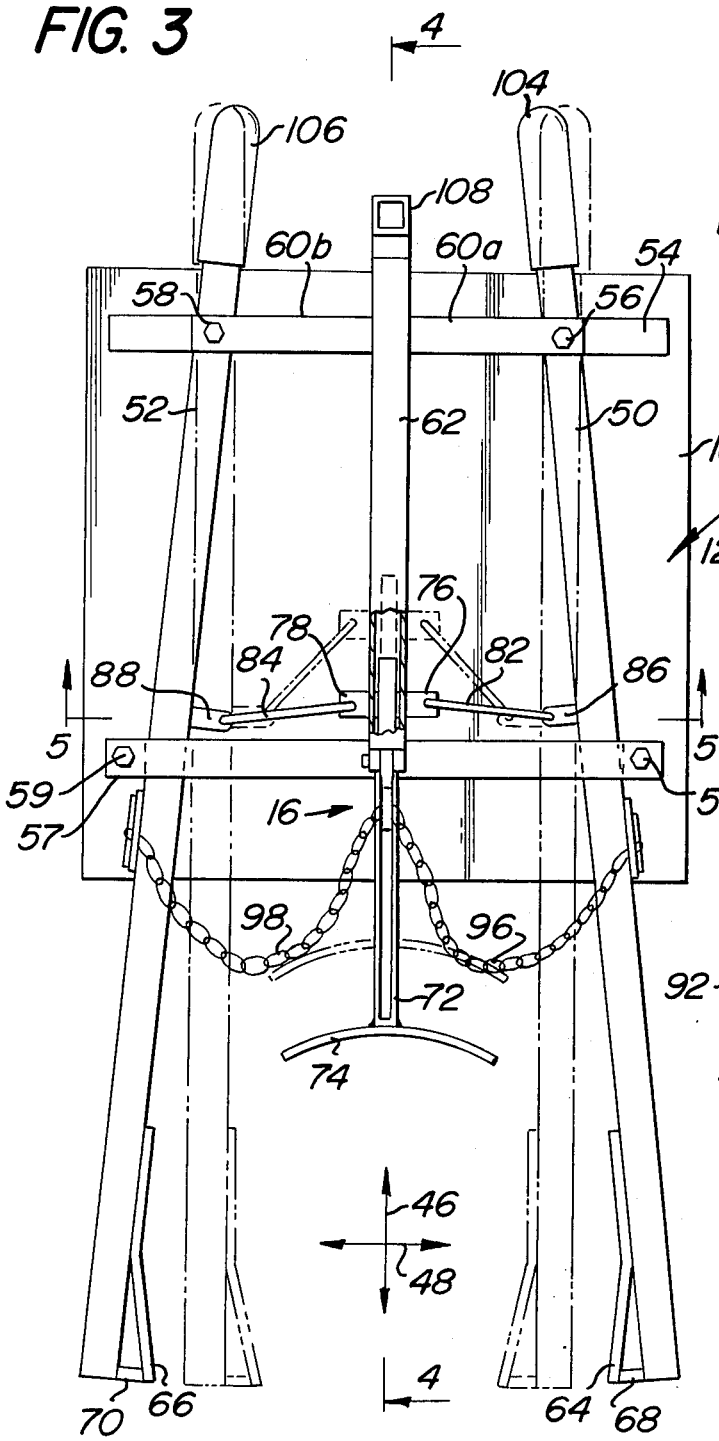
FIG. 3 is an elevational view of the platform mechanism and the stand securing device.

Platform mechanism 12 includes floor or base 18 to be used as a stabilized platform. In general, base 18 is planar in contour in order to provide a stabilizing member upon which the hunter may sit or stand when vertically displaced from the ground surface. Base member 18, as shown in FIGS. 1 and 3 may have a geometric contour approaching a rectangle or a square member however, such is not important to the inventive concept as is herein described. Additionally, floor 18 may be formed of a wooden construction or of a metal such as aluminum or some like material. Additionally, although not necessary to the inventive concept, base or floor member 18 is generally formed or composed of a material which has a low density in order to minimize the problems of carrying improved hunting stand over long distances.

Sectional ladder 14 is adapted to be removably constrained to the ground surface and platform mechanism 12 on opposing ends thereof. Ladder 14 is formed of a plurality of vertical bar elements 20 which are removable each from the other. Bar elements 20 may be consecutively insertable one within the other to provide a displacement of base member 18 from the ground in vertical direction 22 as is clearly seen in FIG. 1. Each of bar elements 20 may be tubular in contour and include opening insert 24 on one end thereof. Insert opening 24 is of a predetermined opening contour area and is adapted to provide a support recess for reduced dimension section 26 of a next consecutively mounted bar element 20. Thus, each bar element 20 would include on one end thereof, insert opening 24 where opening 24 would matingly engage in sliding contact dimension section 26 inserted therein from a next consecutively spaced bar element 20. Shoulder 28 defines the boundary between reduced dimension section 26 and increased dimension section 30 of each bar element 20.

Thus, sectional ladder 14 may be constructed by inserting reduced dimension section 26 into insert opening 24 of a next consecutive bar element 20. Section 26 slidingly engages insert opening 24 of a corresponding next consecutive bar element 20 until shoulder 28 is reached. By matingly engaging each of bar elements 20 in the manner as hereinbefore been described, base member 18 may be constructed in vertical direction 22 to accomodate the needs of the user when supporting improved hunting stand 10 against a tree.

At least one of bar elements 20 includes spike member 32 having a pointed end for ease of driving sectional ladder 14 into the ground. In order that sectional ladder 14 is given a stabilized position when spike member 32 is inserted into the ground, bearing member 34 is mounted and secured to bar element 20 containing spike member 32. Bearing member 34 is generally planar in contour and provides a bearing surface for ladder 14 in order that ladder 14 does not sink into the ground past a predetermined vertical distance. Thus, bearing member 34 provides for an increased surface area to interface with the ground surface in order to lower the stress when a user is climbing sectional ladder 14.

Ladder 14 includes step elements 36 consecutively mounted on opposing sides of vertical bar elements 20 as is clearly seen in FIG. 1. Step elements 36 may be welded, bolted, or otherwise securely mounted to opposing sides of bar elements 20. Although not important concept as is herein described, each of step elements 36 may include a horizontal member 38 adapted to provide support for a user's shoe as well as a support 40 in order to maintain the overall step element 36 in a generally horizontal position when the weight of the user is directed against surface 38. It will be understood that the important concepts of step elements 36 are to provide a platform for the user as he climbs to platform mechanism 12 after improved hunting stand 10 is in a supporting condition against a tree.

Figure 2:
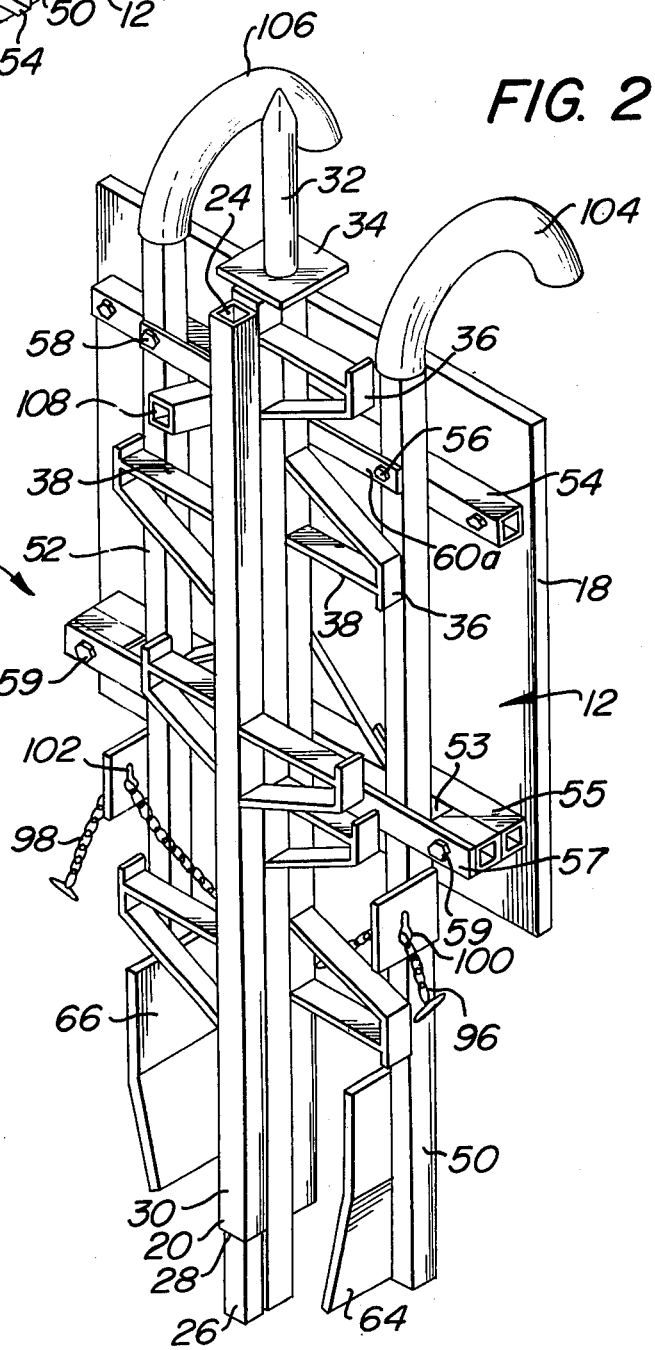
FIG. 2 is a perspective view of the improved hunting stand showing the various elements in compacted form and adapted to be worn on the shoulders of a user.

Each of vertical bar elements 20 include mounting devices formed on opposing transverse walls to allow mounting of bar elements 20 each to the other and to platform mechanism 12 as is shown in FIG. 2. The mounting device includes bolts 42 which are secured and extend from one of the side walls of vertical bar elements 20. Bolts 42 include a head which is insertable within a corresponding key hole or other type slot 44 formed within another of bar elements 20. In this manner, each of bar elements 20 may be mounted each to the other in an adjacent, contiguous fashion as is clearly seen in FIG. 2.

Figure 4:
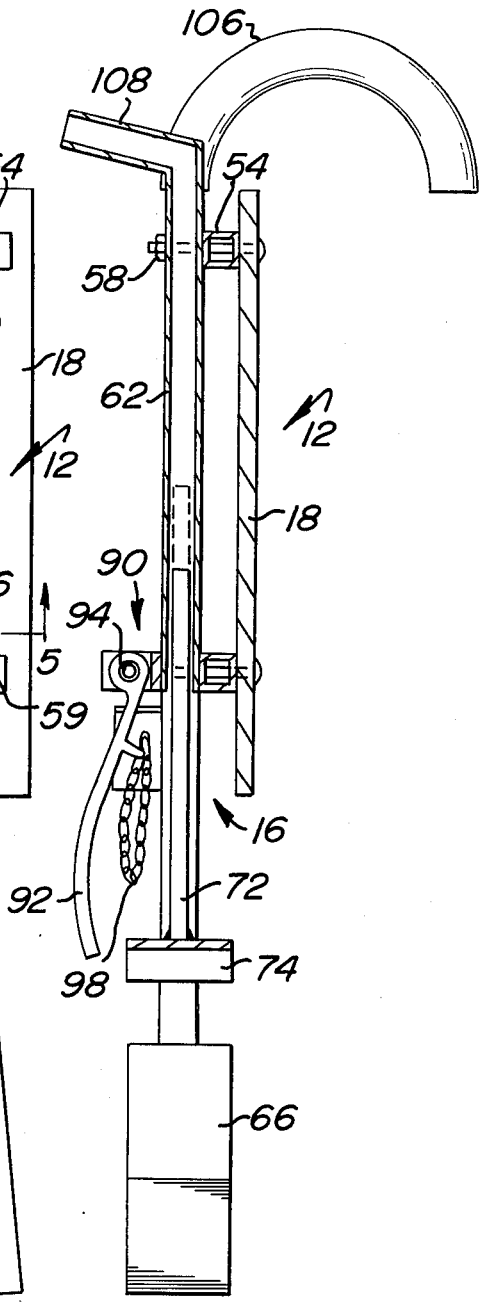
FIG. 4 is an elevational view of the platform mechanism and the stand securing device taken along the section lines 4—4 of FIG. 3; and, FIG. 5 is a frontal sectional view of the sectional of the platform mechanism and the stand securing device taken along the section lines 5—5 of FIG. 3.
Figure 5:
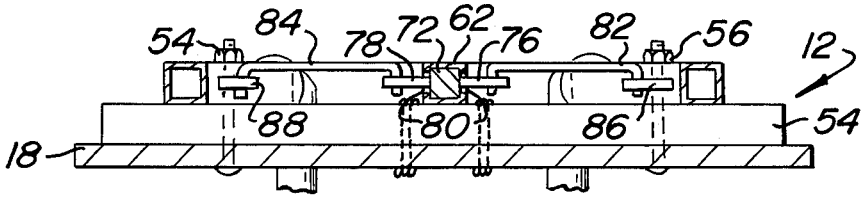

Stand securing device 16 clearly shown in FIGS. 3, 4, and 5 is movably mounted to platform mechanism 12 including floor 18 for frictionally gripping a supporting tree in segmental portions around a peripheral boundary thereof. As will hereinafter be detailed, securing device 16 applies opposing load forces in transverse direction 48 as well as bearing load in longitudinal direction 46.

Securing device 16 includes a pair of arm members 50 and 52 which are rotatably mounted to transversely displaced structural bar member 54 and which itself is mounted in secured fashion to floor or base 18 through bolting or some like mechanism. Arm members 50 and 52 are rotatably mounted to base 18 through pivot bolts 56 and 58 as is clearly seen in FIG. 3. Structural members 60*a, b,* used for structural integrity of hunting stand 10 passes from pivot bolts 56 and 58 respectively to center tubular element 62 and are welded, bolted or securely fastened to member 62.

Additionally, arms 50 and 52 are transversely moveable within transverse slot 53 formed between structural bar members 55 and 57 shown in FIG. 2. Members 55 and 57 are secured to base 18 through bolts 59 or some like mechanism. Thus, arm members 50 and 52 are transversely moveable, as is shown by the phantom line drawings of FIG. 3, with respect to floor or base 18 to aid in gripping the supporting tree on opposing sides thereof.

Arm members 52, 50 include pad members 64 and 66 securely fastened to longitudinally directed ends of arm members 50 and 52. Pad members 64, 66 are generally resilient in nature and as is seen in FIG. 3, are adapted in contour to interface with the supporting tree over a substantial peripheral surface area.

Pad members 64 and 66 may be made of a hardened rubber or some like material which will provide high frictional properties when arms 50 and 52 are positioned to provide for interface contact with the supporting tree. Pad members 64, 66 may be arcuate in contour or may provide for linearly directed sections angled each to the other. Due to the fact that pad members 64, 66 are displaced from supporting arm members 50 and 52 at an end section, structural bars 68 and 70 may secure the ends of pad members 64, 66 to respective arm members 50, 52.

Grip bar 72 is linearly displacable with respect to platform mechanism 12 in longitudinal direction 46 for contacting the supporting tree in cooperation with arm members 50 and 52. Grip bar 72 is slidably insertable within center tubular element 62 to permit longitudinal displacement but linearly constrain the motion of bar 72 in longitudinal direction 46. Bar member 72 includes concave seat 74 adapted in contour to interface in contiguous fashion with an arcuate surface contour of the supporting tree.

Grip bar 72 includes a pair of wing members 76 and 78 which are generally planar in contour and secured to opposing transverse sides of grip bar 72. Slot 80 is disposed in longitudinal direction 46 and is formed on opposing sides of center tubular element 62 to allow movement in longitudinal direction 46 of grip bar 72 and wing member 76 and 78.

Link elements 82 and 84 are rotatably mounted to wings 76 and 78 on one end thereof and to lugs 86 and 88 on opposing ends thereof. Gripping link elements 82 and 84 are rotatable and pivotal with respect to wings 76 and 78 as well as lug members 86 and 88. Lugs 86 and 88 are secured to respective arm members 50 and 52 through bolts, welding or some like mechanism not important to the inventive concept as is herein described. As is seen in FIG. 3, displacement of grip bar 72 in longitudinal direction 46 through the connections of link elements 82 and 84 has a resulting transverse force displacement on arm members 50 and 52.

Stand securing device 16 further includes locking mechanism 90 secured to platform mechanism 12 and arm members 50 and 52 for maintaining arm members 50 and 52 in constrained contact with a boundary wall of the supporting tree. As is seen in FIG. 4, locking mechanism 90 includes rotatable arm member 92 which is rotatable about pivot bolt 94. Chain elements 96 and 98 pass from opposing arm members 50 and 52 respectively and are secured to rotatable arm member 92 through welding or some like mechanism. Chain elements 96 and 98 pass through key hole slots 100 and 102 formed in plates secured to opposing arm members 50 and 52 as is shown in FIGS. 1 and 2. Through the use of key hole slots 100 and 102, the length of chain elements 96 and 98 may be varied in accordance with the particular contour of the supporting tree or other supporting element.

In operation, once pad members 64, 66 and concave seat 74 is placed in contiguous contact with the supporting tree, rotatable arm member 92 is rotated about pivot 94 which draws opposing chain elements 96 and 98 into a taut position. Once in this load bearing position, arms 50 and 52 are maintained in a closed position to add to the gripping force applied against the supporting element.

Arm members 50 and 52 include shoulder mounting elements 104 and 106 which are arcuate in contour and adapted to be worn over the shoulders of a user for permitting the user to carry hunting stand 10 on his back. Shoulder elements 104, 106 may include a rubber or other flexible material inserted over the bar members to provide some comfort for the user when shoulder elements 104 and 106 are positioned in a carrying location on the operator. Additionally, arcuate shoulder arms 104 and 106 may be utilized as arm rests by the user when he or she is sitting upon floor or base 18.

Center tubular element 62 includes a forward portion 108 which extends downward in a substantially vertical inclined direction to permit insertion of a reduced dimensioned section 26 of one of vertical bar elements 20. Inclination of portion 108 is provided in order to maintain base 18 in a horizontal plane when stand 10 is set up. In this manner, vertical bar elements 20 pass between the ground and the platform mechanism 12 to maintain such in a relatively constrained and horizontal position.

Although this invention has been described in connection with specific forms and embodiments thereof, it will be appreciated that various modifications other than those discussed above may be resorted to without departing from the spirit or scope of the invention. For example, equivalent elemental structures may be substituted for those specifically shown and described, certain features may be used independently of other features, and in some cases, elements may be reversed, all without departing from the spirit or scope of the invention as defined in the appended claims.

What is claimed is:

1. A hunting stand vertically displaced from a ground surface and adapted to be mounted to a tree comprising:

a. platform means having an extended planar surface;

b. sectional ladder means removeably constrained to said ground surface and said platform means on opposing ends thereof; and, c. stand securing means moveably mounted to said platform means, said stand securing means including (1) a pair of arm members transversely moveable with respect to said platform means for frictionally gripping said tree on opposing sides thereof, (2) a grip bar member having a substantially smooth concave seat adapted in contour to frictionally interface with an arcuate surface contour of said tree and being linearly displaceable with respect to said platform means in a longitudinal direction for frictionally contacting said tree between said concave seat and said pair of arm members, said stand securing means further including locking means secured to said platform means and said pair of arm members for maintaining said arm members in constrained contact with said boundary wall of said tree, said locking means having a rotatable arm member mounted to said platform means; and, a chain element constrained to said rotatable arm member and passing to a key hole slot formed in at least one of said arm members for positionally constraining said arm member in a predetermined location.

2. The hunting stand as recited in claim 1 where said platform means includes a pair of rigid arcuately contoured shoulder mounting elements formed in one piece construction with said pair of arm members and adapted to be worn over the shoulders of a user for permitting said user to carry said platform means on the back of said user.

* * * * *